US007204180B2

(12) United States Patent
Schwaiger

(10) Patent No.: US 7,204,180 B2
(45) Date of Patent: Apr. 17, 2007

(54) APPARATUS FOR CUTTING PLASTIC PROFILES

(75) Inventor: Meinhard Schwaiger, Linz (AT)

(73) Assignee: Technoplast Kunststofftechnik GmbH, Micheldorf (AT)

( * ) Notice: Subject to any disclaimer, the term of this patent is extended or adjusted under 35 U.S.C. 154(b) by 42 days.

(21) Appl. No.: 10/238,599

(22) Filed: Sep. 11, 2002

(65) Prior Publication Data

US 2003/0047055 A1 Mar. 13, 2003

(30) Foreign Application Priority Data

Sep. 13, 2001 (AT) ..... GM707/2001

(51) Int. Cl.
*B26D 1/00* (2006.01)

(52) U.S. Cl. ..... 83/613; 83/651; 83/697

(58) Field of Classification Search ..... 30/316, 30/357, 346.55, 337, 343, 344, 346; 83/613, 83/624, 620, 636, 651, 697, 581.1, 657
See application file for complete search history.

(56) References Cited

U.S. PATENT DOCUMENTS

| | | | | | |
|---|---|---|---|---|---|
| 175,182 | A * | 3/1876 | Slusser et al. | 83/636 |
| 208,582 | A * | 10/1878 | Fenton | 30/346 |
| 693,524 | A * | 2/1902 | Kom | 30/57 |
| D43,817 | S * | 4/1913 | Gaisman | D28/47 |
| 3,035,344 | A * | 5/1962 | Brown | 30/346 |
| 3,277,764 | A * | 10/1966 | Henc | 83/697 |
| 3,292,478 | A * | 12/1966 | Falk et al. | 30/357 |
| 3,367,335 | A * | 2/1968 | Ward et al. | 30/339 |
| 3,514,856 | A * | 6/1970 | Camp et al. | 30/346.55 |
| 3,693,675 | A * | 9/1972 | Allen | 83/802 |
| 3,714,974 | A * | 2/1973 | Bullard | 83/831 |
| 3,803,968 | A * | 4/1974 | Black | 83/636 |
| 3,845,578 | A * | 11/1974 | Holmstrom | 37/446 X |
| 4,089,562 | A * | 5/1978 | Baumeister | 30/168 |
| D269,108 | S * | 5/1983 | Moeller | D22/118 |
| 5,029,504 | A * | 7/1991 | Wilbur et al. | 83/168 |
| 5,141,353 | A * | 8/1992 | Meredith et al. | 403/267 |
| 5,390,576 | A * | 2/1995 | Ishibashi | 83/697 |
| D366,130 | S * | 1/1996 | Ordonez | D32/46 |
| 5,537,905 | A * | 7/1996 | Zimmer et al. | 83/697 |
| 5,911,808 | A * | 6/1999 | Mendenhall | 83/581.1 |
| 5,924,204 | A * | 7/1999 | Lane | 30/169 |
| 6,151,786 | A * | 11/2000 | Hellstern | 30/346.53 |
| 6,272,962 | B1 * | 8/2001 | Yasoda et al. | 83/697 |
| 6,408,729 | B1 * | 6/2002 | Johnson | 83/697 |
| 6,751,869 | B2 * | 6/2004 | Paggeot | 30/169 |

FOREIGN PATENT DOCUMENTS

| | | | |
|---|---|---|---|
| DE | 266529 | | 4/1989 |
| DE | 0520206 | A1 * | 5/1992 |
| DE | 19618803 | | 11/1997 |
| DE | 29905169 | | 7/1999 |
| DE | 19805343 | | 8/1999 |
| DE | 198 43 262 | A1 * | 3/2000 |
| EP | 0988941 | | 9/1999 |
| EP | 1110685 | | 6/2001 |
| EP | 1293310 | A2 * | 3/2003 |
| FR | 2512704 | | 3/1983 |
| JP | 05293797 | A * | 11/1993 |

* cited by examiner

*Primary Examiner*—Jason Prone
(74) *Attorney, Agent, or Firm*—Dykema Gossett PLLC

(57) ABSTRACT

An apparatus for cutting plastic profiles includes a knife which is guided transversally to the profile, the knife including a cutting section and a holding section, the cutting section defining a guide portion, a transition portion, and a blade portion defining a tip. The guide portion defines opposite external surfaces which are generally flat and parallel, and it has a thickness greater than a thickness of the holding section. The transition portion defines opposite external surfaces which curve from the blade portion to tangentially merge with the opposite external surfaces of the guide portion.

6 Claims, 2 Drawing Sheets

APPARATUS FOR CUTTING PLASTIC PROFILES

BACKGROUND OF THE INVENTION

The invention relates to an apparatus for cutting plastic profiles with a knife which is guided transversally to the profile and comprises a cutting section having a blade and a holding section, with the cutting section extending substantially parallel to the blade and having a larger thickness than the holding section.

Hollow-chamber profiles are extruded into a continuous strand in profile extrusion from materials that can be plastified such as PVC for example and cut to a defined length of e.g. 6,000 mm into profile bars by means of a trimming apparatus. Special sawing units (e.g. flying circular saws) are mainly used for cutting the profiles into length. Due to numerous disadvantages such as the occurrence of dust, production of chips and high levels of noise, alternative methods are increasingly gaining in importance.

Trimming apparatuses for the virtually noiseless severing of profiles made of plastic, and preferably hollow-chamber profiles made of thermoplastic materials, have long been known and are increasingly used in plastic profile extrusion. The principle is based on the known technology of severing by means of a thin plate which is moved in a somewhat even manner through the profile to be severed. This knife plate is provided with a sharp blade. During the contact with the plastic profile a high local cutting pressure is obtained at the blade edge, which pressure produces a molecular transformation in the plastic matrix. A minimal portion of time is needed for the process of molecular transformation, which is why the severing cannot occur abruptly, but requires the adherence to a certain material-dependent minimum speed. A severing knife that is guided in an abrupt manner through the profile would lead to a cutting process similar to a brittle fracture, characterized by splinterings, large deformations and a cutting surface progress that departs from an even surface.

The breakthrough on the market is still obstructed by deficiencies which are linked to this technology. These deficiencies include, among other things, the partly marked deformations of the profile ends in the area of the severing plane which shows more or less strong divergences of the profile walls in the zone of the severing surface due to material crowding by the thickness of the knife plate and the progress of the cutting surface which diverges from the plane surface. Even if the production of profile bars concerns the production of semi-finished goods, special requirements are placed on the quality of the ends of the profile bars, not the least because the geometrical quality of the profile bars is determined by the cross section of the profile bar ends. In the case of an automated check of the profile geometry the performance of a quality check must be possible without any additionally necessary machining of the ends.

DESCRIPTION OF THE PRIOR ART

A severing knife is known from DE 198 05 343 A which comprises a blade which expands at first in a wedge-like manner in its cross section, but tapers subsequently. In this way it is possible to reduce the friction of the blade on the cutting surfaces. It is further known from EP 988 941 A to pretension a severing knife in order to ensure sufficient stability at the lowest possible thickness.

DE 299 05 169 U shows an apparatus for severing profiles with a knife beveled in several stages. Although a certain improvement is thus possible, an only inadequate cutting quality is achieved in many fields of application.

SUMMARY OF THE INVENTION

It is the object of the present invention to further develop an apparatus of the kind mentioned above in such a way that the cleanest possible cut can be achieved where the profile is deformed to a very low extent at the cutting surfaces. In order to enable an inline cut, the cutting speed is to be as high as possible.

These objects are achieved in accordance with the invention in such a way that the cutting section is provided with two guide surfaces which are parallel to each other and to the knife plane and that the blade is delimited by two transition areas which are arranged in a curved manner and each converge into a guide surface. It has been surprisingly noticed that by a combination of different measures it is possible to achieve a substantial increase of the cutting quality. The material is displaced at first at the blade by an blade angle which is not too acute and a centering of the knife is achieved. The relevant aspect for the quality is that the flanks of the knife converge in the cutting section continuously into the guide surfaces through which the knife is guided on the profile. In order to reduce friction the knife tapers after the guide surfaces into a thinner holding section which ensures the structural stability of the knife.

It is particularly favorable when the blade angle is between 45° and 120°, preferably between 60° and 90°.

It is provided for in a particularly favorable embodiment of the invention that the transition zones are provided with a substantially circular-cylindrical arrangement, with a radius which lies between 20 times and 100 times the thickness of the knife in the zone of the guide surfaces. A particularly high cutting quality can be achieved in this way. It has proven to be particularly favorable when the thickness of the transition region lies between 5 times and 10 times the thickness of the knife in the zone of the guide surfaces and when further the thickness of the holding section is between 10% and 20% smaller than the thickness of the knife in the zone of the guide surfaces. In this way it is possible to achieve a high stability of the knife at a low thickness of the same.

It is further particularly favorable when the knife is pretensioned and when the pretensioning occurs both in the direction of the blade as well as in a direction inclined thereto.

BRIEF DESCRIPTION OF THE DRAWINGS

The invention is now explained in closer detail by reference to embodiments shown in the drawings, wherein.

DETAILED DESCRIPTION OF THE PREFERRED EMBODIMENTS

Figure 1:
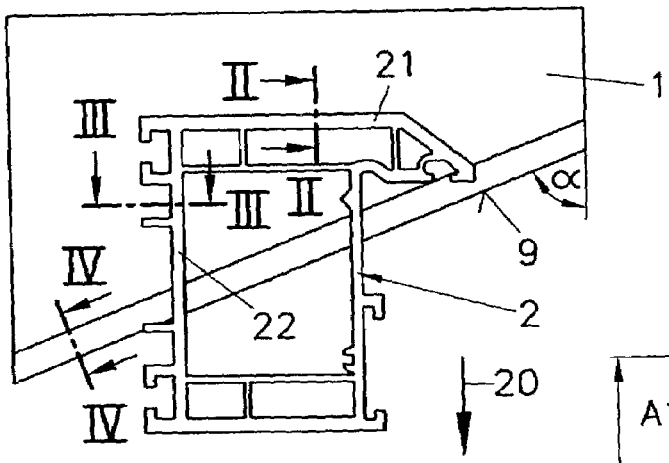
FIG. 1 schematically shows a knife plus the profile to be cut.
Figure 2:
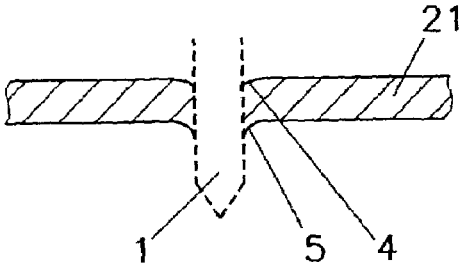
FIG. 2 shows a sectional view along line II—II in FIG. 1.
Figure 3:
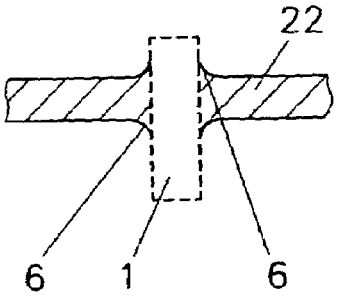
FIG. 3 shows a sectional view along line III—III in FIG. 1.

FIG. 1 shows the knife 1 which severs a plastic profile 2 which is provided for making windows. Knife 1 moves in the direction of arrow 20, with the blade 9 of knife 1 being inclined at an angle α to the direction of movement according to arrow 20 which is 68°. The penetration of the knife 1 leads in the profile 2 to deformations in the cutting surface which depend on the respective position of the webs. In the case of a web 21, which is situated substantially transversally to the direction of movement 20 of the knife 1, there will be a material displacement oriented in one direction, as is shown in FIG. 2. This displacement of material consists of a rounding 4 on the side on which knife 1 penetrates and of a burr 5 on the opposite side.

The formation of burrs 6 occurs on either side in webs 22 which are substantially parallel to the direction of arrow 20.

The relevant aspect of the invention is to keep such roundings 4 and burrs 5, 6 as low as possible.

Figure 4:
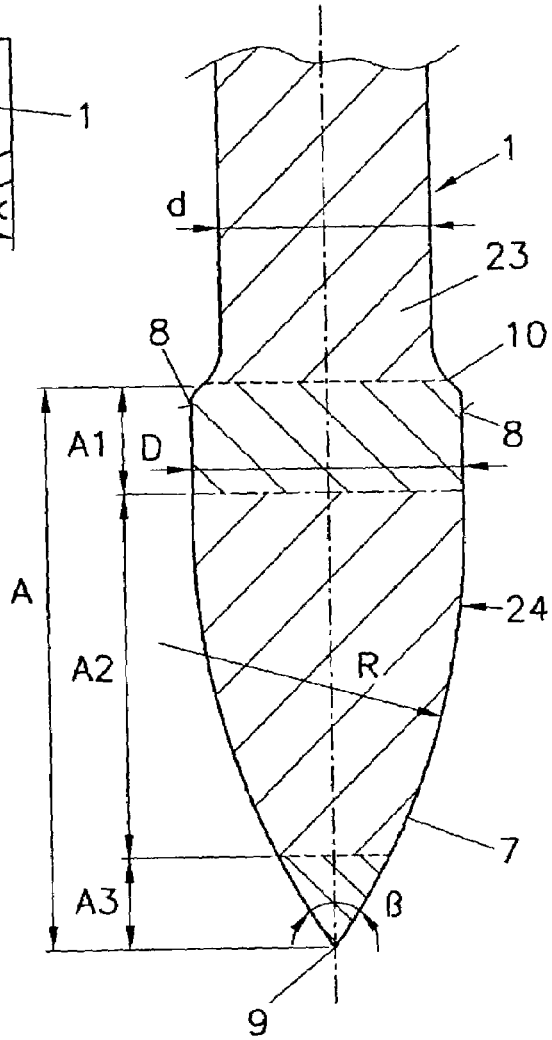
FIG. 4 shows a detail of a knife in accordance with the invention in a sectional view along line IV—IV in FIG. 1.

FIG. 4 shows the structure of knife 1 on an enlarged scale and with an excessive thickness. Although the knife 1 is made integrally, the individual zones are subsequently shown with different hatchings for the purpose of better clarity. The knife 1 consists of a blade portion 9 with a blade angle β of about 60°. The blade portion 9 is followed by a convex transition zone 7 which is arranged in a substantially circular-cylindrical form, having a radius of curvature R. The transition zones 7 converge tangentially into guide surfaces 8 which define the largest expansion of the knife 1 in the direction of thickness. The knife 1 continues after a rounded edge 10 in a tapered holding section 23. The part formed from the blade portion 9, the transition zones 7 and the guide surfaces 8 is designated below as cutting section 24. The thickness D of the knife 1 in the zone of the guide surfaces 8 is 1.2 mm for example for thick-walled profiles. For thin-walled profiles, with a wall thickness of up to 1.5 mm, it is 0.6 mm for example. Thus the thickness d in the zone of the holding section 23 is about 80–85% of the thickness D. The radius R of the transition zone is about 30 times D.

The width A of the cutting section 24 is approximately 2 times D, which is composed of the width A1 of the guide surface 8 of 0.4 times D, the width A2 of the transition zone of 1.2 times D and the width A3 of the actual blade 9 of 0.4 times D.

Figure 5:
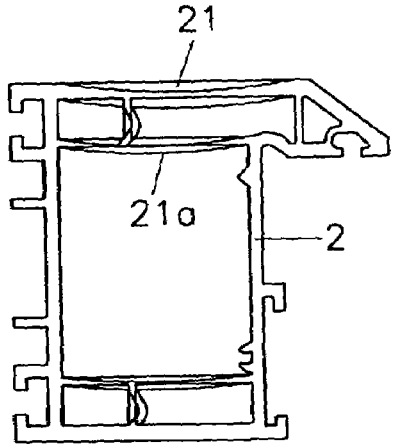
FIG. 5 shows a schematic representation of the possible deformations of a profile.

FIG. 5 shows the possible deformation of the profile 2 by the cutting process. Especially the horizontal webs 21 are deformed by the cutting forces, as is indicated by the lines 21*a* in bold print.

Figure 6:
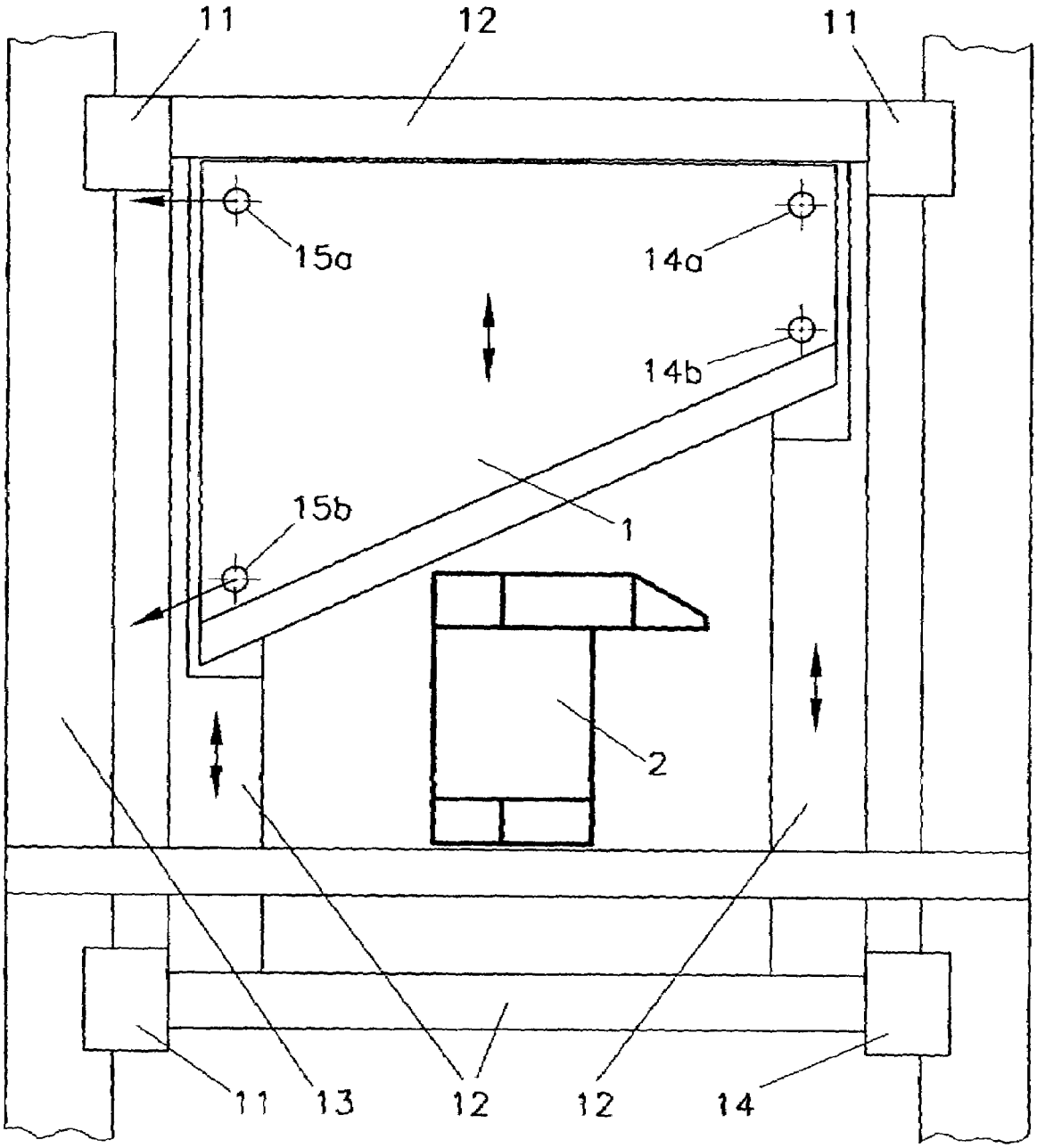
FIG. 6 shows an overall view of an apparatus for severing plastic profiles.

A further improvement in the stability of thin-walled knife plates 1 during the severing process is enabled by the fixing and pretensioning of the knife plate 1. in the tensioning frame 12 of the severing apparatus 13, as shown in FIG. 6. This is achieved in such a way that the knife plate 1 is received at four points 14*a*, 14*b*, 15*a*, 15*b* which are remote from each other and is tensioned in two directions 15*a*, 15*b*. It is irrelevant in this respect whether for the tensioning process two independent tensioning devices (e.g. pretensioning screws) or a tensioning apparatus with a force equilibrium device are used. The relevant aspect is that the knife plate 1 is planarly pretensioned in the stable tensioning frame 12 which is disposed by means of inner bearings 11 and 14 in a vertically movable manner in the basic machine 13. Known tensioning devices (e.g; DE 198 43 262 A1) come with the disadvantage that there is a pretensioning either only via two points in a linear fashion or an undefined, but uneven planar pretensioning due to the kinematics of the flexibly arranged tensioning frame. This leads to the effect that a slight bulging of the knife plate is promoted and a flat severing cut is not possible.

What is claimed is:

1. An apparatus for cutting plastic profiles which comprises an elongated knife defining an edge which in cross section defines:

a holding section having generally planar opposite external surfaces, said holding section defining a thickness, and a cutting section having a guide portion located adjacent the holding section, a blade portion having opposite external surfaces which merge into a blade edge, and a transition portion between the guide portion and the blade portion; the guide portion having opposite external surfaces that include a convex section that merges into a generally planar section and a thickness greater than said thickness of the holding section, said generally planar section of said opposite external surfaces of said guide portion being parallel to each other as they extend towards the blade edge, and said transition portion having opposite external surfaces which extend in a curved, convex manner from said opposite external surfaces of said blade portion to tangentially merge with said opposite external surfaces of said guide portion.

2. An apparatus according to claim 1, wherein said opposite external surfaces of said blade portion define a blade angle of between 45° and 120°.

3. An apparatus according to claim 1, wherein said opposite external surfaces of said transition portion extend along a radius which is 20 to 100 times said thickness of said guide portion.

4. An apparatus according to claim 1, wherein said thickness of said holding section is about 80 to 85% said thickness of said guide portion.

5. An apparatus according to claim 1, including a means for mounting said knife for pretensioning in a longitudinal direction and in a direction inclined to said longitudinal direction.

6. An apparatus according to claim 1, wherein said elongated knife has a trapezoidal configuration.

* * * * *